US006390309B1

(12) United States Patent
Tucker

(10) Patent No.: US 6,390,309 B1
(45) Date of Patent: May 21, 2002

(54) SPORTING EQUIPMENT HAMMOCK

(76) Inventor: Timothy R. Tucker, 90 Forest Hill Dr., Rochester, NY (US) 14625

( * ) Notice: Subject to any disclaimer, the term of this patent is extended or adjusted under 35 U.S.C. 154(b) by 0 days.

(21) Appl. No.: 09/815,075

(22) Filed: Mar. 22, 2001

(51) Int. Cl.[7] ..... A47F 5/00

(52) U.S. Cl. ..... 211/85.7; 211/103; 211/207; 211/193; 224/563; D6/552

(58) Field of Search ..... 211/85.7, 70.5, 211/60.1, 193, 207, 208, 103, 13.1; D6/552; 224/563

(56) References Cited

U.S. PATENT DOCUMENTS 4,732,102 A * 3/1988 Holman et al.
4,823,965 A * 4/1989 Hughes ..... 211/60.1
5,027,960 A * 7/1991 Rainville ..... 211/60.1 X
5,044,505 A * 9/1991 Spratt ..... 211/13.1 X
5,623,750 A * 4/1997 Nasin et al.
5,833,079 A * 11/1998 Roberts ..... 211/85.7
5,950,844 A * 9/1999 Taylor ..... 211/85.7
6,129,224 A * 10/2000 Mingers ..... 211/193
6,142,492 A * 11/2000 DeLucia
6,164,465 A 12/2000 Schroeder
6,253,932 B1 * 7/2001 Lindsey ..... 211/60.1 X

* cited by examiner

*Primary Examiner*—Robert W. Gibson, Jr.
(74) *Attorney, Agent, or Firm*—Greenwald & Basch LLP; Duane C. Basch

(57) ABSTRACT

The present invention is an apparatus for holding sporting equipment. The rack includes a pair of U-shaped arms spaced apart from one another and in a generally equivalent horizontal position. At least one flexible longitudinal support is suspended between the arms and at least one flexible lateral support is suspended between opposing ends of each arm so that lateral and longitudinal supports, in combination, support the sporting equipment thereon without contacting the arms.

15 Claims, 7 Drawing Sheets

TRT-3

SPORTING EQUIPMENT HAMMOCK

This invention relates generally to a sporting equipment hammock and more particularly to an adjustable rack system for the storage and display of sporting equipment, watercraft such as kayaks, canoes and articles associated therewith.

BACKGROUND AND SUMMARY OF THE INVENTION

The present invention is directed to a sporting equipment hammock, including a rigid frame, adjustable supports and suspension straps for providing a uniform support to sporting equipment including personal watercraft such as kayaks, sea kayaks, canoes, etc.

Heretofore, patents and publications have disclosed sporting equipment racks, the relevant portions of one of which may be briefly summarized as follows:

U.S. Pat. No. 6,164,465 to Scott Schroeder, issued Dec. 26, 2000, discloses an improved rack for storing a wide variety of sports equipment in a secure, organized fashion, in a relatively small space. In a preferred embodiment, the rack has a U-shaped main frame that is mounted to a wall, for example, in a garage.

In accordance with the present invention, there is provided a rack for holding sporting equipment, comprising: a pair of parallel vertical members, laterally-spaced in relation to each other; a U-shaped first arm coupled to a first one of said vertical members and a U-shaped second arm coupled to a second one of said vertical members, the first and second arms being substantially parallel and extending outward and perpendicularly to a plane defined by said vertical members; at least one flexible longitudinal support suspended between said first arm and said second arm; and at least one flexible lateral support suspended between opposing ends of each of said arms, wherein the lateral and longitudinal supports, in combination, support the sporting equipment thereon without contacting the arms or vertical members.

In accordance with another aspect of the present invention, there is provided a rack for holding sporting equipment, comprising: at least two vertical members, laterally-spaced and parallel with each other; a floor-support associated with the bottom of each of at least two of said vertical members, said floor support being fixedly associated with a respective vertical member and holding said vertical member in its vertical position; a bridge member, spanning the lateral spacing between at least two of said vertical members so as to retain the lateral spacing therebetween; a U-shaped first arm adjustably coupled to a first one of said vertical members and a U-shaped second arm adjustably coupled to a second one of said vertical members, the first and second arms being substantially parallel and extending outward and perpendicularly to a plane defined by said vertical members; at least one flexible longitudinal support suspended between said first arm and said second arm; and at least one flexible lateral support suspended between opposing ends of each of said arms, wherein the lateral and longitudinal supports, in combination, support the sporting equipment thereon without contacting the arms or vertical members.

One aspect of the invention deals with a basic problem in the storage and display of sporting equipment such as kayaks, surf boards, wind surfers, etc.—the longitudinal and lateral support of equipment that is not flat in shape. This aspect is further based on the discovery of a technique that alleviates this problem. The technique employs a rack, support arms and flexible lateral and longitudinal supports whereby the equipment may be supported over a substantial portion of its length, without touching rigid surfaces. The techniques described herein are advantageous because it is both simple and flexible in its application, allowing for a common rack system to be employed for a variety of equipment types. As a result of the invention, users of kayaks, surf boards, wind surfers and other sporting equipment may have a convenient way of storing and displaying such equipment.

Figure 1:
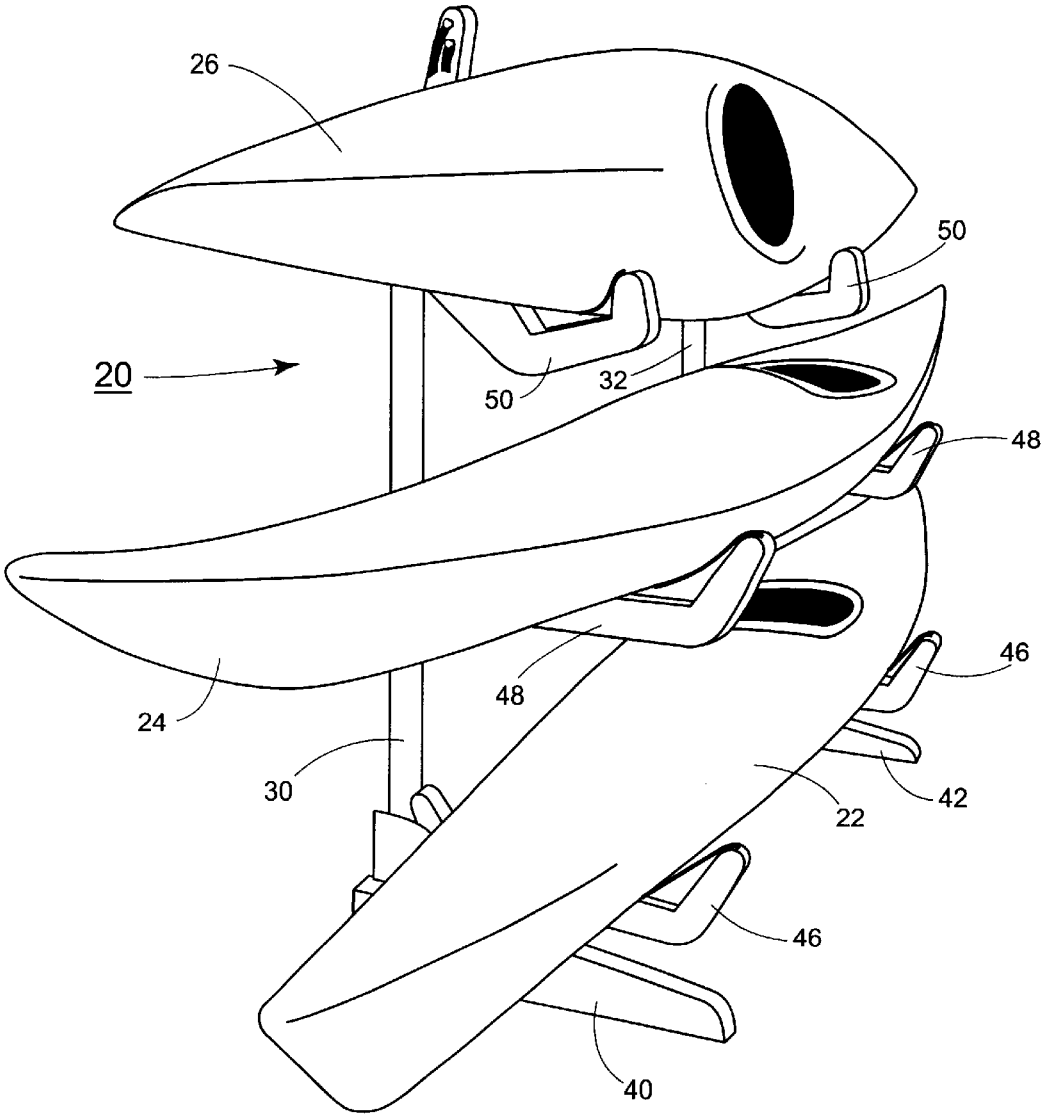
FIG. 1 is a perspective illustration of an embodiment of the present invention in use.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements.

Referring to FIG. 1, there is shown a perspective illustration of an embodiment of the present invention used to store sporting equipment in the nature of personal watercraft. More specifically, a rack 20 is employed to support three kayaks 22, 24 and 26. However, the rack may be employed to support other sporting equipment such as skis, hang-gliders, sailboards and wind surfers, sails, etc. as the present invention is particularly adapted to provide lateral and longitudinal suspension of such equipment while stored.

Figure 2:
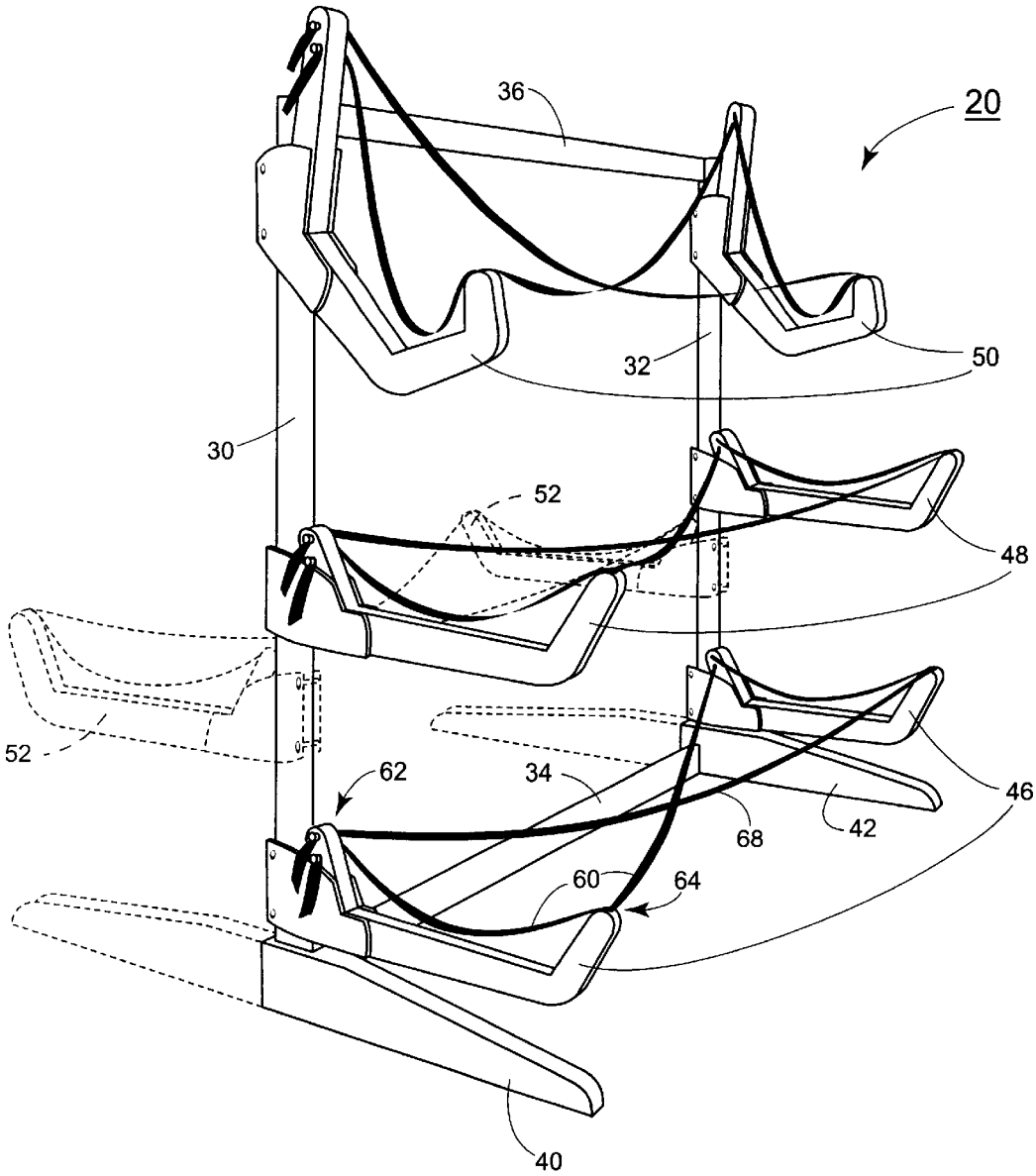
FIG. 2 is a perspective view of the embodiment of FIG. 1 without the sporting equipment.

Referring also to FIG. 2, rack 20 includes at least two vertical support members 30 and 32, spaced apart from one another a distance of between 1.5 meters and 3.0 meters. It will be appreciated that the horizontal distance separating the members 30 and 32 is, to a large extent, dependent upon the length of the items being supported by the rack. The vertical members, and indeed many of the elements of the rack 20, may be manufactured from hardwoods, metal or even plastic components, although hardwoods are believed preferrable for aesthetic reasons. Use of metal components may require painting or other surface treatments in order to assure that the components do not corrode with exposure to moisture.

Members 30 and 32 are maintained in an upright position through one of a plurality of supporting mechanisms. In the embodiment depicted in FIG. 1, members 30 and 32 may be maintained in an upright position via a base or floor supports 40 and 42, respectively. As depicted in the figures, the bases are attached to the bottoms of vertical members 30 and 32, so as to support the vertical members in a generally upright position. While depicted as extending perpendicularly outward from a plane defined by the vertical members, it is also possible that the bases extend rearwardly as well, as depicted in dashed-lines in FIG. 2, so as to allow rack 20 to support equipment on either the front or rear sides of the vertical members 30 and 32. Lastly, it also possible to support vertical members 30 and 32 on a wall or other vertical structure using brackets (not shown) that anchor the vertical members to the wall and space them away from the wall to enable adjustment of the height of the U-shaped pairs of arms 46, 48 and 50.

Referring to FIG. 2, which is a perspective view of the embodiment of FIG. 1 without the sporting equipment, the vertical members 30 and 32 provide structural support for the pairs of arms 46, 48, 50 and 52, so that the pairs may be adjusted to support sporting equipment such as kayaks 22, 24 and 26. Each of the pairs of arms, although differing in actual size and configuration, are generally U-shaped and are adjustably coupled to a first one of the respective first or second vertical members 30 and 32. As placed on the vertical members, the arms are preferably substantially parallel and horizontally aligned, extending forward or rearward in a direction generally perpendicular to a plane defined by the vertical members.

Also included in the rack, in situations where the vertical members are not attached to a wall, is at least one and preferably two bridge members 34 and 36. The bridge members serve to retain the vertical members in a spaced-apart relationship. Bridge members 34 and 36 may be manufactured from the same materials as the vertical members, and may be reinforced or constructed with an "L" shaped or "U" channel cross-section so as to withstand forces tending to bow or buckle the bridge members when heavy sporting equipment is supported by the arms on rack 20.

As will be noted by a close examination of FIG. 1, the kayaks 22, 24 and 26 are not supported directly upon the U-shaped arms, but are preferably supported by a fabric strap or an equivalent flexible support suspended at opposite ends of the U-shaped arms. In a preferred embodiment, the strap is extended so as to continue from the outward end of the U-shaped arm to the inward end of the second arm of the horizontal pair. Straps 60 and 68 are preferably made from woven polypropylene fiber, and may also be made from nylon, polyester, and other synthetic or natural fibers. The straps are of a size of approximately 3 centimeters wide and 2 millimeters thick, depending upon the weight of the load to be supported by the straps.

For example, referring to the lower-most arms 46 in FIG. 2, strap 60 extends from the inward end of the first arm at location 62, where it is adjustably attached, to the outward end of the same arm, location 64, and then onward to the inward end of the second arm at location 66. Strap 60 provides at least one flexible longitudinal support suspended between the first arm and the second arm. In a preferred embodiment, a second strap 68 is similarly suspended from the second arm to the first arm. Thus, straps 60 and 68, either alone or in combination, provide longitudinal support for the equipment being supported by the arms. In combination with that portion of straps 60 and 68 that are suspended from the inward to the outward end of each arm, the straps provide both lateral and longitudinal supports for the sporting equipment thereon, so that the equipment is supported without contacting the arms or vertical members of the rack.

It will be further appreciated that similar suspension means such as a woven netting or mesh (open weave), a strong fabric such as canvas (closed weave) and combinations of straps, netting and/or canvas may be employed to provide the longitudinal support. Furthermore, open and closed weave fabrics may also be employed in the present invention to provide storage for associated gear such as paddles, lifejackets, etc. It is also contemplated that the arms may include hooks or other suspension mechanisms to allow for the storage of gear suspended beneath the arms.

Figure 3:
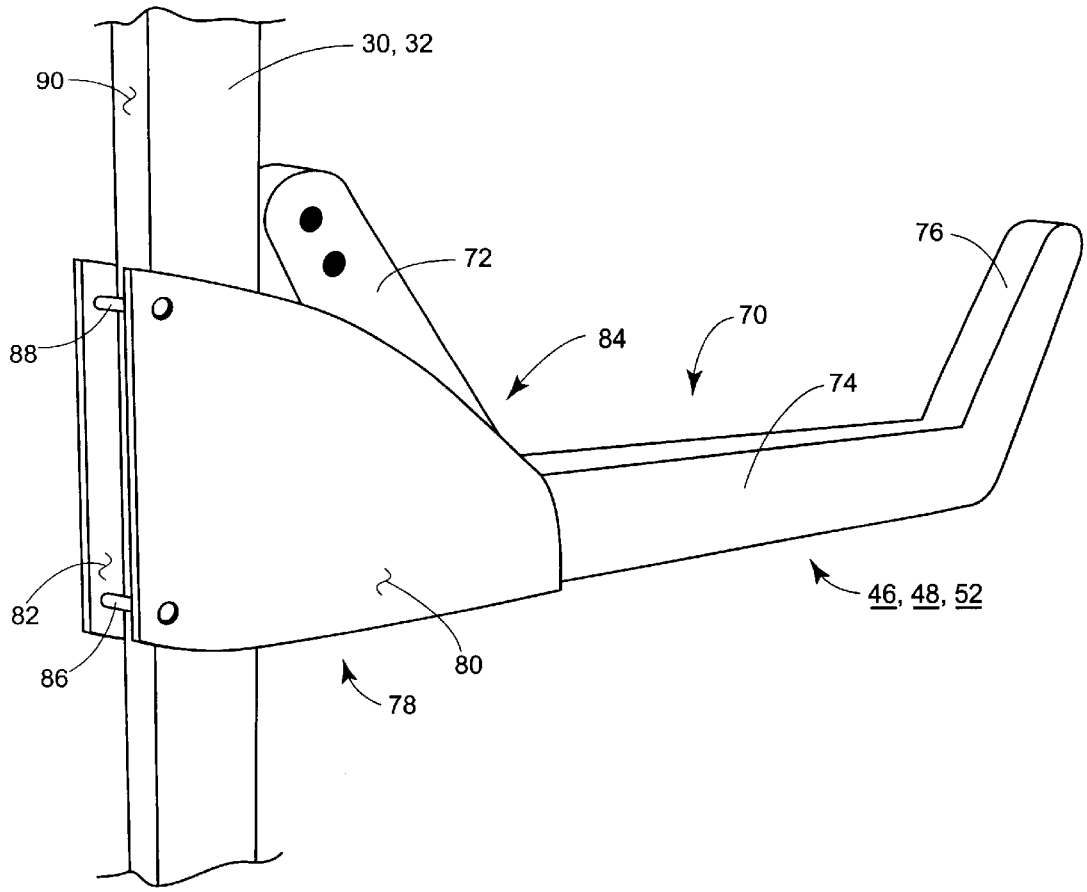
FIG. 3 is a perspective view of an arm of the embodiment of FIG. 1 illustrating its attachment to a vertical member.

Turning next to FIG. 3 there is depicted a perspective view of a lower arm 46, 48, 52 of the embodiment of FIGS. 1 and 2, illustrating its attachment to a vertical member 30 or 32. The arm is comprised of a U-shaped body 70 that includes an inward leg 72, a center member 74 and an outward leg 76. Body 70 may be cut from a single piece of stock (board wood or plywood), or preferably formed from three separate pieces of board wood that are joined with one another (e.g., glued mortise & tenon joints for strength). Also included in the arms is an attachment mechanism 78, wherein the adjustable attachment mechanism allows the arms to be moved in a vertical direction along the respective vertical member 30 or 32. As depicted in FIG. 3, the attachment mechanism 78 includes a pair of spaced-apart flanges 80 and 82 attached to and extending from the elbow region 84 of the U-shaped arm. At least one and preferably two releasable fasteners, 86 and 88, pass through both of the flanges, wherein a tightening of the fasteners results in the two flanges being drawn into frictional contact with the vertical member. Fasteners 86 and 88 may be any type of locking mechanism, pins, threaded bolt/nut, etc., and are preferably a carriage bolt, having a diameter of approximately 8 mm and a length of 7.5 cm. Moreover, once a piece of equipment is supported on the pair of arms, the downward force applied to the arm causes the attachment mechanism to rotate slightly and the releasable fasteners themselves engage surface 90 of the vertical member.

Figure 4:
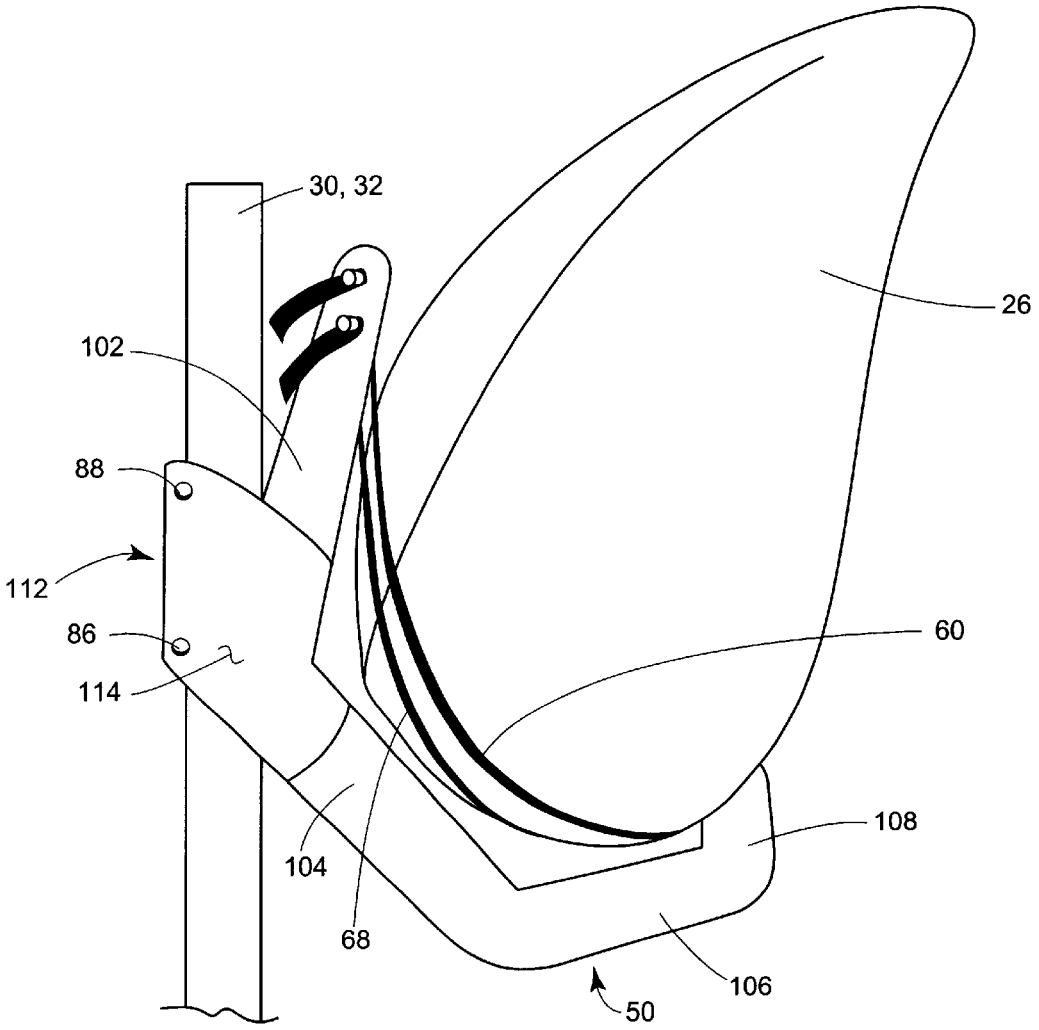
FIG. 4 is a side view of another arm of the embodiment of FIG. 1 illustrating its attachment to a vertical member and use in the support of a piece of equipment.

Turning next to FIG. 4, there is illustrated a side view of the upper arm 50 of FIG. 1. Arm 50, although remaining U-shaped, includes four sections, an inward leg 102, a center member 104, an outward leg 106 and a return member 108. As illustrated, arm 50 is similarly attached to a vertical member 30, 32 and is preferably used in the support of a piece of equipment with a narrower profile than arms of the style described above. For example, kayak 26 is a smaller kayak that is able to be stored in the rack 20 on its side. Arms 50 include similar strap supporting mechanisms for straps 60 and 68. The arms also include an attachment mechanism 112 that, like the other arms, enables adjustable attachment of the arm to its respective vertical member 30 or 32. As depicted in FIG. 4, the attachment mechanism 112 includes a pair of spaced-apart flanges (only facing flange 114 shown) attached to and extending from an elbow of the arm. At least one and preferably two releasable fasteners, 86 and 88, pass through both of the flanges, and tightening of the fasteners draws the flanges together and into frictional contact with the vertical member.

A further modification of the rack 20 may include notches or recesses on the front and/or rear surfaces (e.g., 90) of the vertical members 30 and 32. Although not required, the notches may be used to enable the rack to support increased loads. The notches, or other markings, may also be employed to assist the user in adjusting the heights of respective pairs of arms—where a user could align the arms in accordance with a notch or mark.

Although described with respect to a frame including vertical members 30 and 32, it will be appreciated that the arms and support straps of the present invention may be easily adapted to fit conventional frame studding employed in many stick-built homes and garages. Although the arms may not be adjustable in such a situation, it will be appreciated that the arms may be fastened to vertical studs by drilling holes suitable for receiving fasteners 86 and 88 therethrough.

Figure 5:
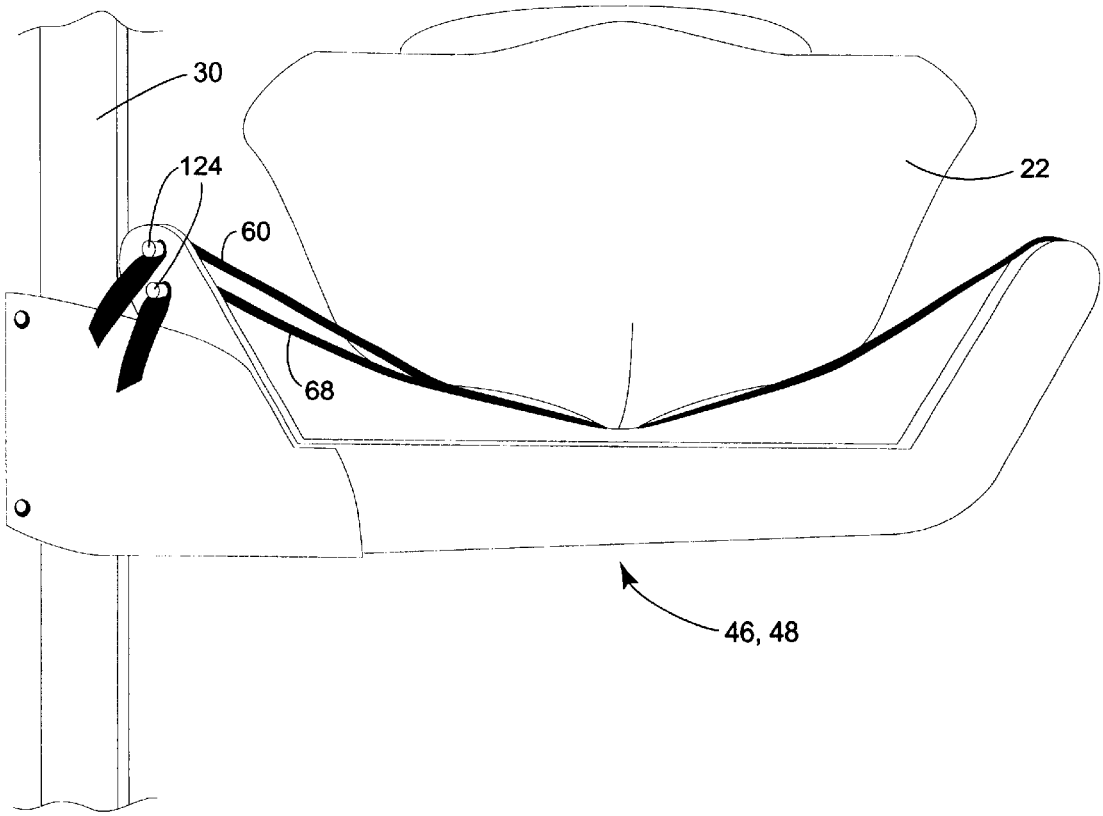
FIG. 5 is an alternative view of the arm of FIG. 3 illustrating its use in the support of a piece of equipment.
Figure 6:
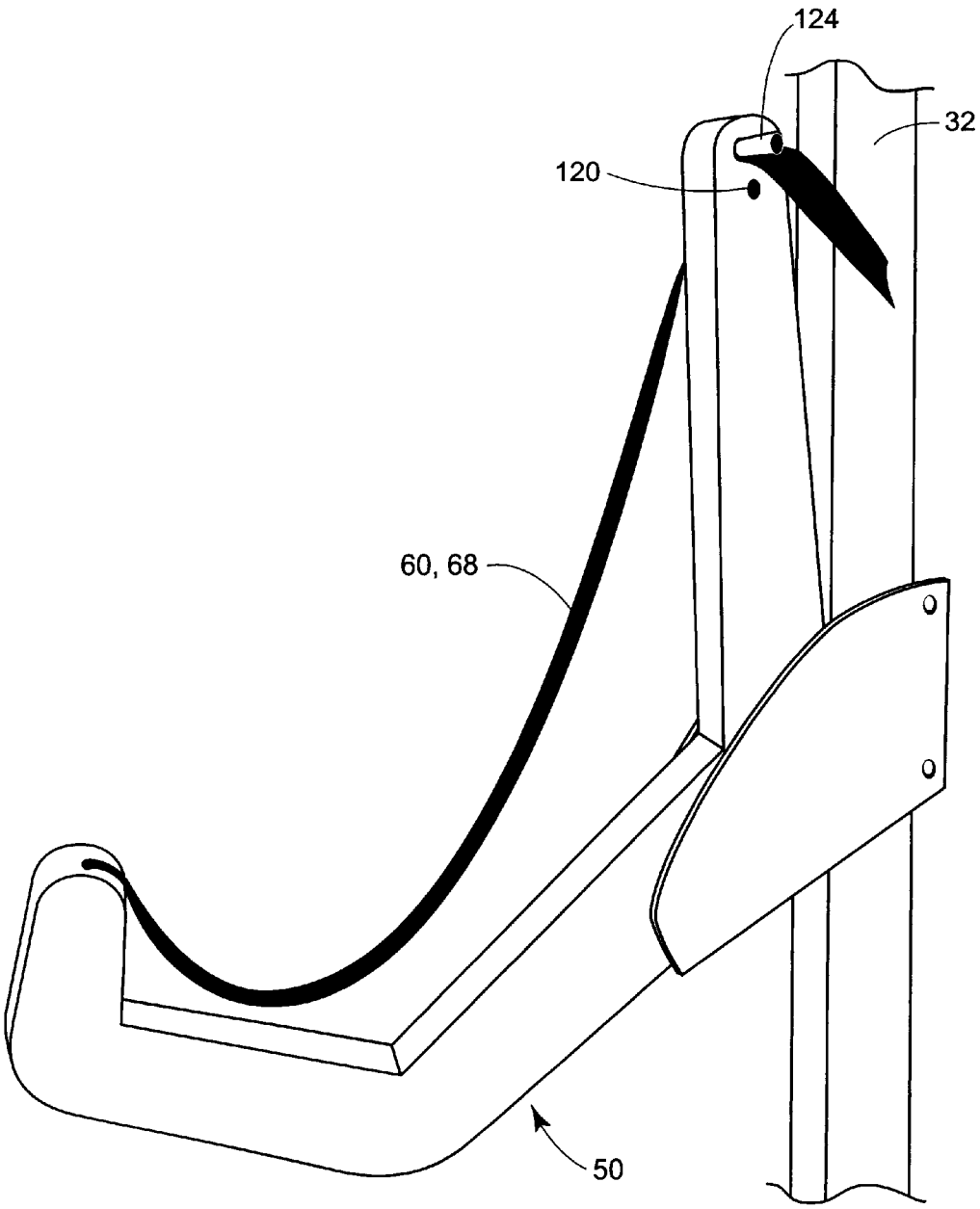
FIGS. 6 and 7 are, respectively, perspective and orthogonal; views of the support strap adjustment mechanisms employed in one embodiment of the present invention.
Figure 7:
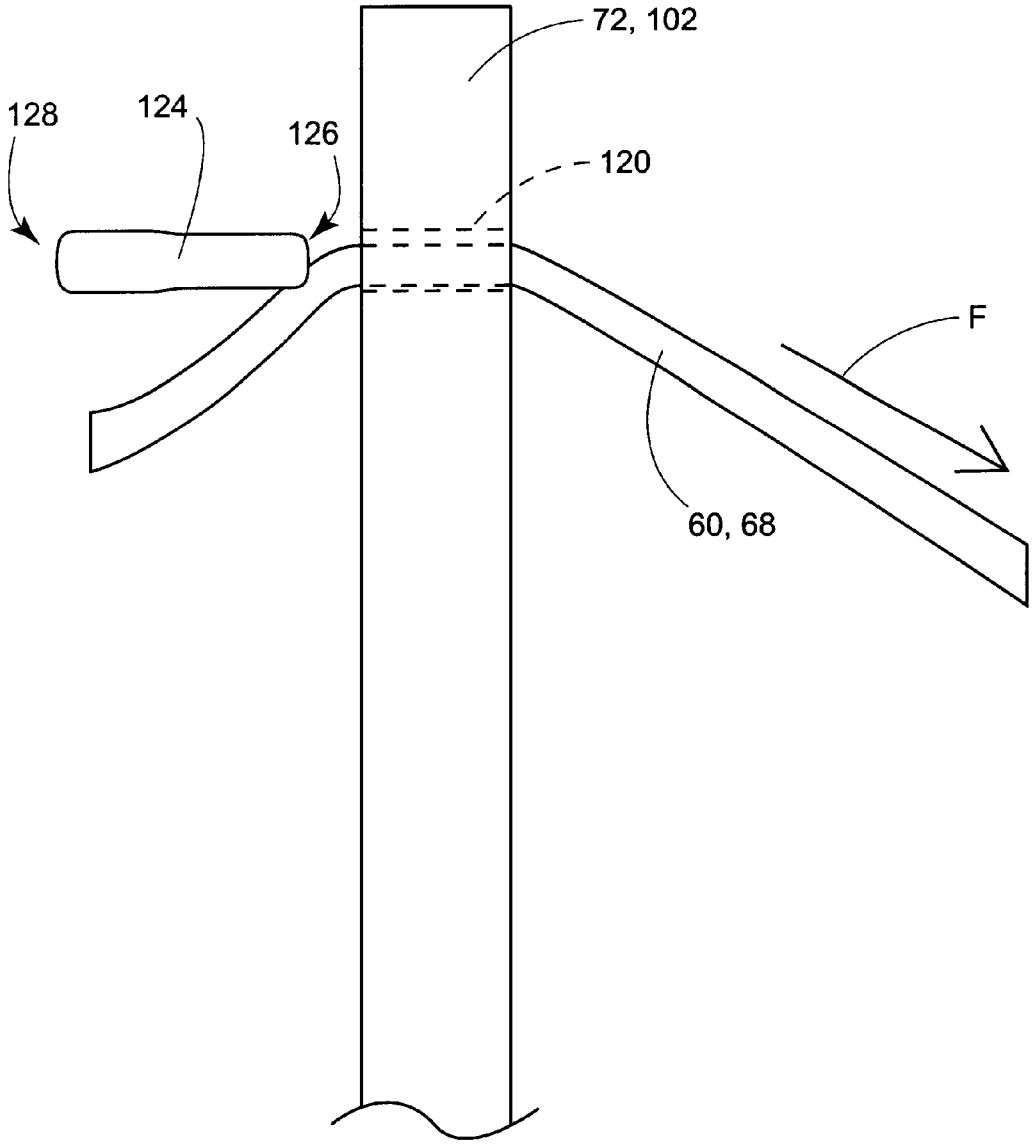

Referring now to FIGS. 5, 6 and 7 there are depicted various views of the U-shaped arms, supporting straps and support strap adjustment mechanisms employed in an embodiment of the present invention. As described above, each of the arms 46, 48, 50 and 52 includes an inward leg 72, 102 that, at its end has a strap 60, 68 connected thereto. While various methods may be employed to connect the straps to the inward leg of each arm, it is believed preferable to use a releasable or adjustable attachment mechanism. In one embodiment, the releasable mechanism includes a hole 120 through which an end of the strap 60, 68 is threaded. Hole 120 is preferably about 1.3 centimeters in diameter, and may be adapted in accordance with the strap width and thickness employed. Once the strap is threaded through the hole, the length of the strap is adjusted to a preferred length and then a plug 124 is inserted into the hole 120.

A plug 124, as seen in cross-section in FIG. 7, is tapered so as to be smaller at end 126 than it is at the opposite end 128. Once inserted into hole 120, the plug pinches the strap in the hole, resisting a pulling of the strap. Furthermore, when a piece of equipment is being supported by the strap, as described above, a force is exerted on the strap in the direction indicated by arrow F, and the force serves to further tighten the plug and strap as it draws the plug 124 further into hole 120.

Alternatively, a plurality of releasable mechanism may be employed to connect the straps to the inward legs of the arms. Examples of equivalent mechanisms include hooks or pins inserted through holes or grommets in the straps, clamping mechanisms such as used to restrain ropes, and clamps or pinching mechanisms that attach to the strap and would prevent it from being drawn into the hole 120.

In the embodiments depicted herein, the straps 60 and 68 are fixedly connected to the outer leg of at least one arm at a point between the ends of the straps, and both ends are then free to be adjusted using the plugs or other attachment mechanisms described above. It will be further appreciated that it is also possible to permanently fix one end of the straps at an inward leg of a first arm, while having the strap slidably affixed to an outer end of the second arm and then releasably attached to the inward end of the second arm. In that manner, the adjustment of the strap would change the level of suspension both on the arm and between arms. Because of the difficulty in adjusting the straps in the later embodiment, it is believed that an adjustment on both ends of the straps is preferred.

In recapitulation, the present invention is an apparatus for holding sporting equipment. The rack includes a pair of U-shaped arms spaced apart from one another and in a generally equivalent horizontal position. At least one flexible longitudinal support is suspended between the arms and at least one flexible lateral support is suspended between opposing ends of each arm so that lateral and longitudinal supports, in combination, support the sporting equipment thereon without contacting the arms.

It is, therefore, apparent that there has been provided, in accordance with the present invention, an apparatus for storing and displaying equipment . While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A rack for holding sporting equipment, comprising:

a pair of parallel vertical members, laterally-spaced in relation to each other;

a U-shaped first arm coupled to a first one of said vertical members and a U-shaped second arm coupled to a second one of said vertical members, the first and second arms being substantially parallel and extending outward and perpendicularly to a plane defined by said vertical members;

at least one flexible longitudinal support suspended between said first arm and said second arm; and at least one flexible lateral support suspended between opposing ends of each of said arms, wherein the lateral and longitudinal supports, in combination, support the sporting equipment thereon without contacting the arms or vertical members.

2. The rack of claim 1, wherein the rack further includes:

a base to which the vertical members are attached at their respective bottoms; and at least one bridge member spanning between the respective vertical members, wherein the combination of the base and the bridge provides sufficient support to retain the vertical members in a generally vertical, spaced-apart position.

3. The rack of claim 1, wherein the vertical members are supported by attachment to a fixed vertical surface.

4. The rack of claim 1, wherein the U-shaped arms include an adjustable attachment mechanism so that said arms may be moved in a vertical direction along the respective vertical member.

5. The rack of claim 1, wherein the attachment mechanism includes:

a pair of spaced-apart flanges attached to and extending from an elbow of the U-shaped arm;

a releasable fastener, passing through both of said flanges, wherein a tightening of said fastener results in the two flanges being drawn into frictional contact with the vertical member.

6. The rack of claim 1, wherein said flexible longitudinal support is a fabric strap.

7. The rack of claim 1, wherein at least one end of said flexible longitudinal support is rigidly affixed to said first arm and wherein an opposite end thereof of is releasably attached to said second arm.

8. The rack of claim 1, wherein said flexible longitudinal support and at least one flexible lateral support is made from a continuous fabric strap.

9. The rack of claim 8, wherein said continuous fabric strap is made from woven strands of polypropylene fiber.

10. The rack of claim 1, wherein said U-shaped arms are adjustably coupled to said vertical members.

11. The rack of claim 4, wherein the U-shaped arms include a plurality of pieces permanently joined to one another.

12. The rack of claim 11, wherein the plurality of pieces are made of wood, and the pieces are joined with mortise and tenon joints.

13. A rack for holding sporting equipment, comprising:

at least two vertical members, laterally-spaced and parallel with each other;

a floor-support associated with the bottom of each of at least two of said vertical members, said floor support being fixedly associated with a respective vertical member and holding said vertical member in its vertical position;

a bridge member, spanning the lateral spacing between at least two of said vertical members so as to retain the lateral spacing therebetween;

a U-shaped first arm adjustably coupled to a first one of said vertical members and a U-shaped second arm adjustably coupled to a second one of said vertical members, the first and second arms being substantially parallel and extending outward and perpendicularly to a plane defined by said vertical members;

at least one flexible longitudinal support suspended between said first arm and said second arm; and at least one flexible lateral support suspended between opposing ends of each of said arms, wherein the lateral and longitudinal supports, in combination, support the sporting equipment thereon without contacting the arms or vertical members.

14. The rack of claim 13, wherein said floor support extends from a respective vertical member in a direction perpendicular to a plane defined by said vertical members.

15. The rack of claim 13, wherein said floor support extends in two directions from a respective vertical member in directions perpendicular to a plane defined by said vertical members and where a plurality of pairs of U-shaped arms may extend outward and perpendicularly to the plane defined by said vertical members.

* * * * *